US009601869B2

(12) United States Patent
Sekino

(10) Patent No.: US 9,601,869 B2
(45) Date of Patent: Mar. 21, 2017

(54) CONNECTOR

(71) Applicant: YAZAKI CORPORATION, Tokyo (JP)

(72) Inventor: Tetsuya Sekino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/249,576

(22) Filed: Aug. 29, 2016

(65) Prior Publication Data

US 2016/0372866 A1 Dec. 22, 2016

Related U.S. Application Data

(63) Continuation of application No. PCT/JP2015/056971, filed on Mar. 10, 2015.

(30) Foreign Application Priority Data

Mar. 26, 2014 (JP) ..... 2014-063749

(51) Int. Cl.
*H01R 13/631* (2006.01)
*H01R 13/641* (2006.01)
*H01R 13/645* (2006.01)

(52) U.S. Cl.
CPC ..... *H01R 13/631* (2013.01); *H01R 13/641* (2013.01); *H01R 13/6456* (2013.01)

(58) Field of Classification Search
None
See application file for complete search history.

(56) References Cited

U.S. PATENT DOCUMENTS 8,075,333 B2 * 12/2011 Bolik ..... H01R 13/629 439/374
2003/0017748 A1 1/2003 Morita et al.
2011/0201228 A1 * 8/2011 Schumacher ..... H01R 13/4368 439/374
2013/0109254 A1 * 5/2013 Klardie ..... A61N 1/0534 439/887

FOREIGN PATENT DOCUMENTS

JP H01-159375 U1 11/1989
JP H04-038679 U1 3/1992
JP H10-003963 A 1/1998
JP 2001-006802 A 1/2001
JP 2003-031316 A 1/2003

* cited by examiner

*Primary Examiner* — Briggitte R Hammond
(74) *Attorney, Agent, or Firm* — MOTS LAW, PLLC

(57) ABSTRACT

This connector is provided with a male connector part (10) including male terminals (11), and a female connector part including female terminals. The male connector pan (10) and a second connector part are fitted together in a fixed fitting direction, and the male terminals (11) and the female terminals are connected. At least one of the outer peripheral surfaces (12*a*, 23*a*) of the male connector part (10) and the female connector part has, provided thereto, a plurality of front-alignment indicators (16*a*, 16*b*, 16*c*, 26*a*, 26*b*, 26*c*) which have an appearance that changes in accordance with the rotational angle of the viewing direction. At least one of the front-alignment indicators (16*a*, 16*b* 16*c*, 26*a*, 26*b*, 26*c*) can be seen in cases in which the at least one of the outer peripheral surfaces (12*a*, 23*a*) is viewed from a direction at rotational angle.

3 Claims, 6 Drawing Sheets

11
12
13
14
15
16a
16b
16c
12a
A
B
C
D
60°

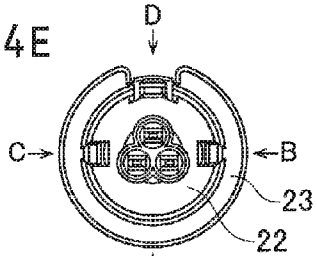
FIG. 4E
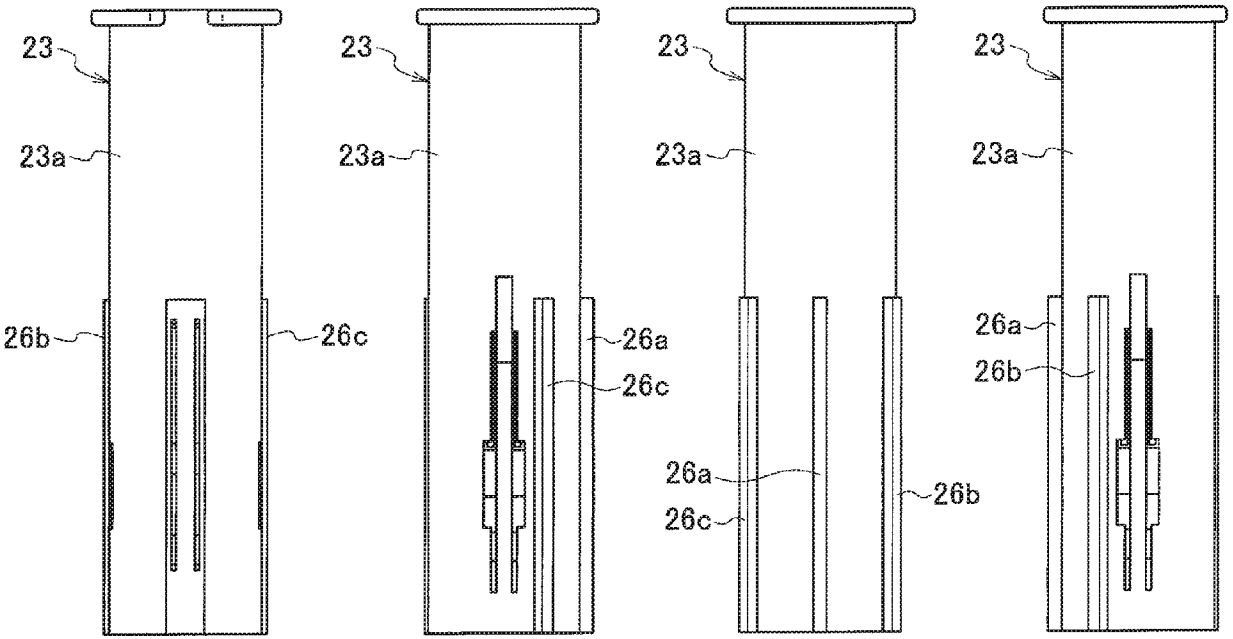
FIG. 4A
FIG. 4B
FIG. 4C
FIG. 4D

CONNECTOR

CROSS REFERENCE TO RELATED APPLICATIONS

This application is a Continuation of PCT Application No. PCT/IP2015/056971, filed on Mar. 10, 2015, and claims the priority of Japanese Patent Application No. 2014-063749, filed on Mar. 26, 2014, the content of both of which is incorporated herein by reference.

BACKGROUND

Technical Field

The present invention relates to a connector for achieving electrical connection by fitting two connector parts with each other.

Related Art

For example, the connector consists of a first connector part having a first terminal and a second connector part having a second terminal. During fitting of the connector, since connections axe allowed only between the first and second terminals corresponding to each other, they are configured to be finable in only a prescribed fitting direction (see JP 10-3963 A and PP 2001-6802 A). Therefore, the worker is required to perform the fitting operation by viewing both the front shapes (terminal arrangement patterns) of the first connector part and the second connector part.

Meanwhile, as shown in FIG. 6, regarding the first connector part 50 to be fixed to a mounting portion 60 by screwing, the front orientation of the first connector part 50 is not constant. Moreover, there are cases where the periphery of the first connector part 50 may include a structure 61 for example, and thus the worker cannot visually recognize the opening orientation of the first connector part 50 from above, or may have difficulty of recognizing.

SUMMARY OF THE INVENTION

Therefore, conventionally, in situations where there is a problem in the visibility of the front shape of the first connector part or the second connector part, there have been problems that fitting operations cannot be performed easily.

Accordingly, the present invention has been made to solve the problems described above, and an object thereof is to provide a connector which can allow easy fitting operations without visually recognizing the front shapes.

A first aspect according to the present invention is a connector including a first connector part having a first terminal. a second connector part being fitted to the first connector part in a prescribed fitting orientation and having a second terminal to be connected to the first terminal, and a plurality of front-alignment indicators provided on an outer peripheral surface of at least one of the first connector part and the second connector part such that at least one of the plurality of front-alignment indicators is visible even when the outer peripheral surface is viewed from any rotational angle direction and appearances of the plurality of front-alignment indicators change when a rotational angle direction from which the outer peripheral surface is viewed changes.

The plurality of front-alignment indicators may be provided at three or more positions, and all of the front-alignment indicators may be arranged in a region smaller than half the outer peripheral surface in a circumferential direction, and the front-alignment indicators located at both ends of the region in which the front-alignment indicators are arranged may be protrusions. The plurality of front-alignment indicators may be provided on both outer peripheral surfaces of the first connector part and the second connector part and the plurality of front-alignment indicators provided on both outer peripheral surfaces of the first connector part and the second connector part may be provided at same rotational positions with respect to a front orientation. Two front-alignment indicators located at both ends may have protrusion heights such that both of the two front-alignment indicators are visible when viewed from a rotational angle direction opposite to a rotational angle direction from which all the front-alignment indicators can be seen to be located symmetrically.

According to the present invention, since the front orientation can be recognized by the appearance of front-alignment indicators, the fitting between the connector parts can be performed easily without viewing the front shapes.

BRIEF DESCRIPTION OF DRAWINGS

FIG. 4A is a view illustrating a rear view of a female connector part according to the embodiment of the present invention;

FIG. 4B is a view illustrating a left side view of the female connector part according to the embodiment of the present invention;

FIG. 4C is a view illustrating a front view of the female connector part according to the embodiment of the present invention;

FIG. 4D is a view illustrating a right side view of the female connector part according to the embodiment of the present invention;

FIG. 4E is a view illustrating a plan view of the female connector part according to the embodiment of the present invention;

DETAILED DESCRIPTION

Hereinafter, an embodiment of the present invention will be described based on the drawings.

Figure 1:
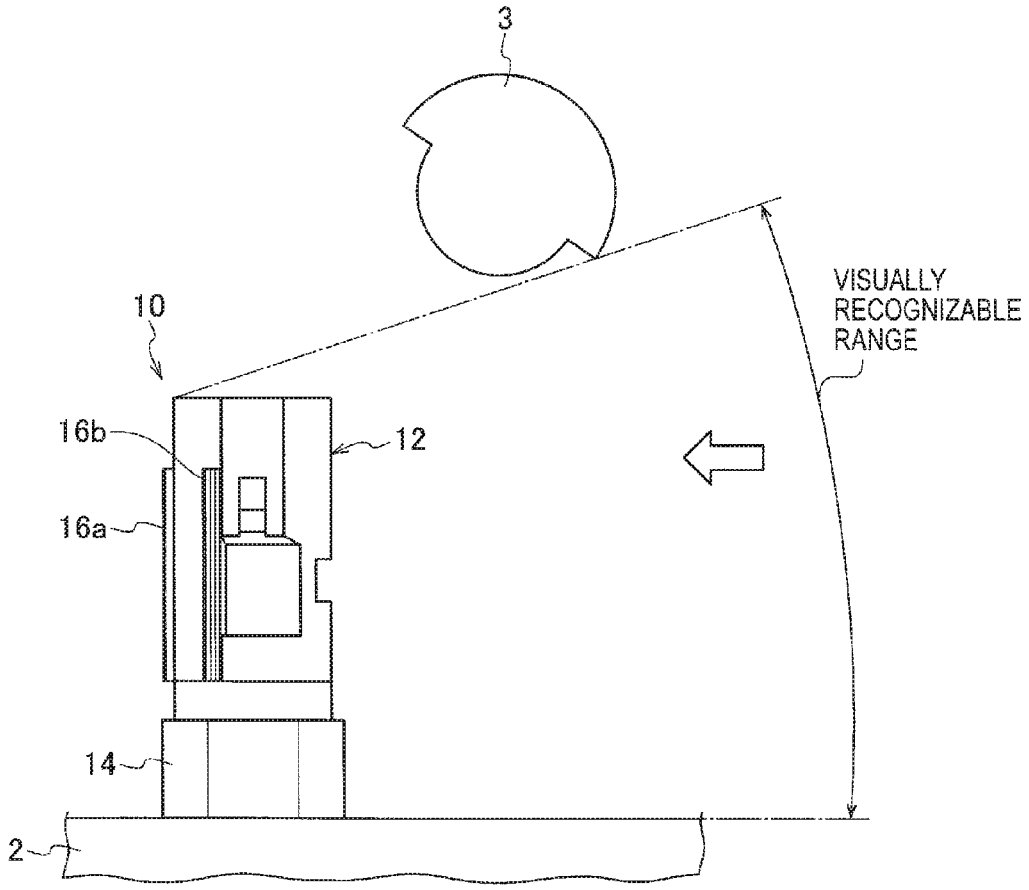
FIG. 1 is a front view illustrating an installation state of a male connector part according to an embodiment of the present invention.
Figure 2:
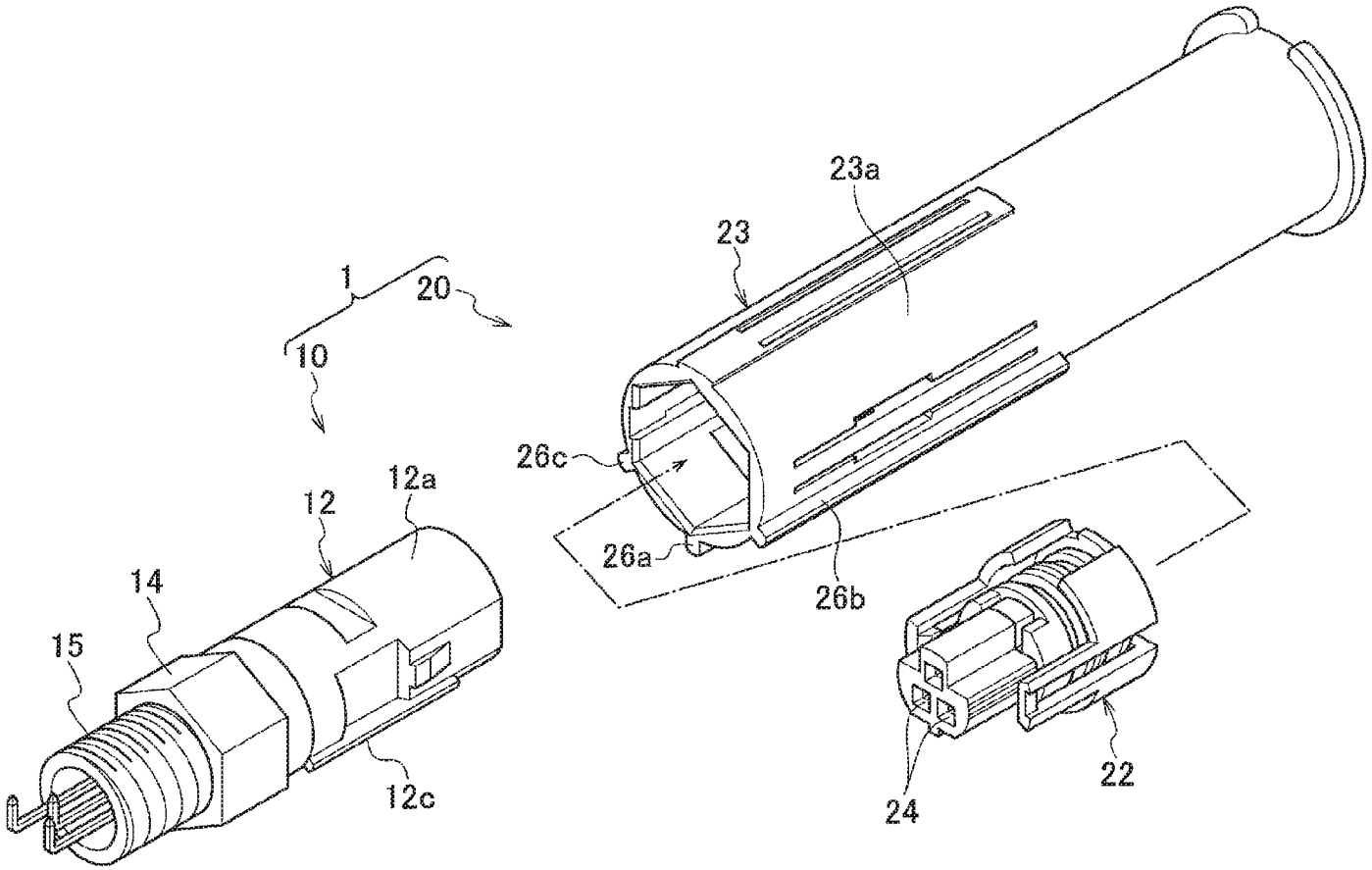
FIG. 2 is an exploded perspective view illustrating a connector according to the embodiment of the present invention.

FIGS. 1 to 4E illustrate an embodiment of the present invention. As shown in FIG. 2, a connector 1 consists of a male connector part 10 as a first connector part and a female connector part 20 as a second connector part.

Figures 3A, 3B, 3C, 3D, 3E:
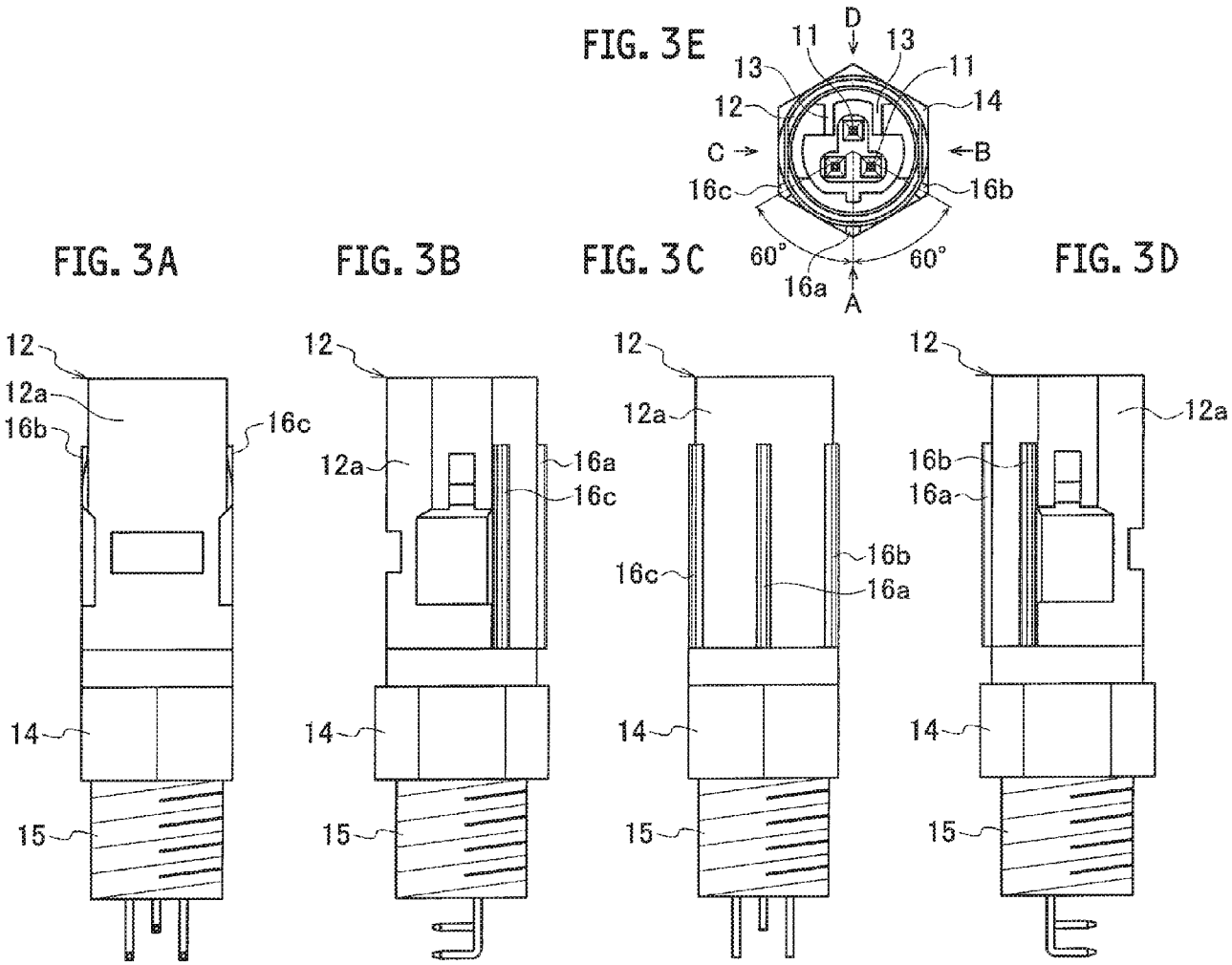
FIG. 3A is a view illustrating a rear view of the male connector part according to the embodiment of the present invention.
FIG. 3B is a view illustrating a left side view of the male connector part according to the embodiment of the present invention.
FIG. 3C is a view illustrating a front view of the male connector part according to the embodiment of the present invention.
FIG. 3D is a view illustrating a right side view of the male connector part according to the embodiment of the present invention.
FIG. 3E is a view illustrating a plan view of the male connector part according to the embodiment of the present invention

The male connector part 10, as shown in FIGS. 2 and 3E, has male terminals 11 as a plurality (three) of first terminals and a male housing 12 in which the male terminals 11 are arranged. The male housing 12 is in a substantially cylindrical shape, and the upper surface has an opening. The male terminals 11 are housed in the opening. On the inner surface of the male housing 12, ribs 13 for allowing the fitting of the normal orientation of the female connector 20 and preventing the fitting of non-normal orientation are provided. A fixing nut portion 14 and a threaded portion 15 are provided on the lower side of the male housing 12.

The outer peripheral surface 12*a* of the male housing 12 is substantially formed as a circular circumferential surface. On this male housing outer peripheral surface 12*a*, as shown in FIGS. 3A to 3E, a plurality of male connector front-alignment indicators 16*a*, 16*b* and 16*c* are provided such that at least one of them can be visually recognized in the case of viewing the outer peripheral surface 12*a* from any direction of the rotational angle, and the appearances of them changes when the viewing direction of the rotational angle changes. The plurality of front-alignment indicators 16*a*, 16*b* and 16*c* are arranged at three positions within a region smaller than half the area of the outer peripheral surface 12*a* in the circumferential direction. The front-alignment indicators 16*a*, 16*b* and 16*c* at the three positions are arranged at 60 degree angle intervals around the center of rotation. In this embodiment, the three from-alignment indicators 16*a*, 16*b* and 16*c* are arranged within the region of the outer peripheral surface 12*a* corresponding to the range of a rotational angle of 120 degrees. The front-alignment indicators 16*a*, 16*b* and 16*c* at the three positions are an elongated protrusions extending in the axial direction of a cylindrical shape of the male housing 12. All three are protrusions of the same length. Two front-alignment indicators 16*b* and 16*c* located at both ends have protrusion heights such that both of them are visible when seen from the rotational angle direction (rear view described below) opposite to the rotational angle direction from which all the front-alignment indicators 16*a*, 16*b* and 16*c* can be seen to be located symmetrically (front view described below).

In the male housing 12, when the orientation in FIG. 3C is defined as the front for convenience, the front-alignment indicators 16*a*, 16*b* and 16*c* have appearances as follows.

In the front view (arrow A direction), three front-alignment indicators 16*a*, 16*b* and 16*c* can be visually recognized at bilaterally symmetric positions. In the right side view (arrow B direction), two front-alignment indicators 16*a* and 16*b* are visible at positions deflected to the left side. In the left side view (arrow C direction), two front-alignment indicators 16*a* and 16*c* are visible at positions deflected to the right side. In the rear view (arrow D direction), two front-alignment indicators 16*b* and 16*c* which protrudes from the left and right ends of the male housing 12 are visible. Thus at least one of them is visible when the outer peripheral surface 12*a* is viewed from any rotational angle direction, and the appearance changes when the rotational angle direction of the viewing changes.

As shown in FIG. 1, the male connector part 10 is installed by screwing and fixing the threaded portion 15 to the mounting portion 2. The male connector part 10 is fixed by a screw fixation, and thus not fixed in a constant orientation.

The female connector part 20 is provided with female terminals (not shown) consisting of a plurality (three) of second terminals, an inner housing 22 in which these female terminals are arranged and an exterior housing 23 which houses the inner housing 22. On the lower surface of the inner housing 22, openings 24 which the male terminals 11 enter (shown in FIG. 2) are formed. Between the outer periphery of the inner housing 22 and the inner peripheral surface of the exterior housing 23, a gap (not shown) which the male housing 12 enters is formed.

The exterior housing 23 is cylindrical in shape and an exterior housing outer peripheral surface 23*a* is a circular circumferential surface. The outer peripheral surface 23*a*, similarly to the male housing 12 as shown in FIGS. 4A to 4E, has a plurality of female connector front-alignment indicators 26*a*, 26*b* and 26*c*, at least one of which is visible when the outer peripheral surface 23*a* is viewed from any rotational angle direction and whose appearances change when the rotational angle direction of the viewing changes. The plurality of front-alignment indicators 26*a*, 26*b* and 26*c* are arranged at three positions in a region smaller than half the area of the outer peripheral surface 23*a* in the circumferential direction. The front-alignment indicators 26*a*, 26*b* and 26*c* at three positions are arranged at the positions at 60 degree intervals of the angle around the center of rotation. In this embodiment, the three front-alignment indicators 26*a*, 26*b* and 26*c* are arranged in the region of the outer peripheral surface 23*a* corresponding to the range of the rotational angle of 120 degrees. The front-alignment indicators 26*a*, 26*b* and 26*c* at the three positions are elongated protrusions extending in the axial direction of the cylindrical shape of the exterior housing 23. All the protrusions at the three positions are of the same length. Two front-alignment indicators 26*b* and 26*c* located at both ends have protrusion heights such that both of the indicators are visible when seen from the rotational angle direction (rear view described below) opposite to the rotational angle direction from which all the front-alignment indicators 26*a*, 26*b* and 26*c* are seen to be located symmetrically (front view described below).

In the exterior housing 23, when the orientation of FIG. 4C is defined as the front for the sake of convenience, the female connector front-alignment indicators 26*a*, 26*b* and 26*c* are provided at the same rotational positions as the male housing outer peripheral surface 12*a* of the male connector part 10 with respect to the front orientation. Therefore, the female connector front-alignment indicators 26*a*, 26*b* and 26*c* of the female connector part 20 have appearances of the same pattern as the male housing 12. Then, the front orientations of the male connector part 10 and the female connector part 20 accord with each other by aligning the mutual front-alignment indicators 16*a*, 16*b*, 16*c*, 26*a*, 26*b* and 26*c* to each other.

In the above configuration, as for the installation situation of the male connector part 10, there is a structure 3 around the male connector part 10 as shown in FIG. 1. Therefore, the range which can be visually recognized by the operator is limited and the front shape of the male connector part 10 cannot be visually recognized, or is recognized with difficulty.

The outer peripheral surface 12*a* of the male housing 12 is provided with the male connector front-alignment indicators 16*a*, 16*b* and 16*c*, at least one of which is visible when the male housing outer peripheral surface 12*a* is viewed from any rotational angle direction, and whose appearances change when the rotational angle direction of the viewing changes. The worker can recognize the front orientation without viewing the front shape and with viewing only the male housing outer peripheral surface 12*a*, by previously recognizing the relationship between the appearance pattern of the male connector front-alignment indicators 16*a*, 16*b* and 16*c* of the male housing 12 and the front orientation. The fore, the female connector part 20 can be easily fitted with the male connector part 10.

Although it is sufficient that only the male connector front-alignment indicators 16*a*, 16*b* and 16*c* may be provided to the male connector part 10 having an invisible front shape or poor visibility of the front shape, the female connector front-alignment indicators 26*a*, 26*b* and 26*e* are provided to the exterior housing outer peripheral surface 23*a* of the female connector part 20 in addition in this embodiment. Therefore, the front orientation of the female connector part 20 can be recognized by viewing only the exterior housing outer peripheral surface 23*a* without actually viewing the front orientation of the female connector part 20.

Moreover, in this embodiment, the front-alignment indicators 16*a*, 16*b*, 16*c*, 26*a*, 26*b* and 26*c* of both the male connector part 10 and the female connector part 20 are provided at the same rotational positions therebetween relative to the front orientation. Therefore, by aligning the mutual front-alignment indicators 16*a*, 16*b*, 16*c*, 26*a*, 26*b* and 26*c* to each other, the front orientations agree with each other and the female connector part 20 can be fined more easily with the male connector part 10. That is, as in this embodiment, by providing the front-alignment indicators 16*a*, 16*b*, 16*c*, 26*a*, 26*b* and 6*c* to both the male connector part 10 and the female connector part 20, actual viewing of the front shape becomes unnecessary, and moreover, the female connector part 20 can be easily fitted with the male connector part 10 without taking into consideration the relationship between the appearance pattern of the front-alignment indicators 16*a*, 16*b*, 16*c*, 26*a*, 26*b* and 26*c* and the front orientation.

The plurality of front-alignment indicators 16*a*, 16*b*, 16*c*, 26*a*, 26*b* and 26*e* are provided in three or more positions on each part, and the front-alignment indicators 16*b*, 16*c*, 26*b* and 26*c* on both sides are protrusions, and then all the front-alignment indicators 16*a*, 16*b*, 16*c*, 26*a*, 26*b* and 26*c* are arranged in a region smaller than half of each of the outer peripheral surfaces 12*a* and 23*a* in the circumferential direction. Since the front-alignment indicators 16*b*, 16*c*, 26*b* and 26*c* on both sides are protrusions, the range where the indicators are visible from the surroundings is increased and the installation space of the plurality of front-alignment indicators 16*a*, 16*b*, 16*c*, 26*a*, 26*b* and 26*c* can be as small as possible. Then, the space used for other objects can be widen on the outer peripheral surfaces 12*a* and 23*a*. Since the front-alignment indicators 16*a*, 16*b*, 16*e*, 26*a*, 26*b* and 26*c* are located at three positions on each. part, the difference in appearance depending on the rotational angle direction is simple, and thus, the recognizability is improved. Incidentally, the indicators may also be provided at four or more positions as a matter of course.

Two of the front-alignment indicators 16*b*, 16*e*, 26*b* and 26*c* located at both ends have protrusion heights such that both of the indicators may be visible when viewed from the rotational angle direction (rear view described below) opposite to the rotational angle direction (front view described below) from which all the front-alignment indicators 16*a*, 16*b*, 16*c*, 26*a*, 26*b* and 26*c* can be seen to be located symmetrically. Thus, two of the front-alignment indicators 16*b*, 16*c*, 26*b* and 26*c* can be seen at the right and left ends of each of the outer peripheral surfaces 12*a* and 23*a* in the rear view. In this appearance, the central front-alignment indicators 16*a* and 26*a* are missing differently from the appearance in the front view and it becomes easy to infer the rear view, whereby the visibility is improved.

Since the outer peripheral surfaces 12*a* and 23*a* of the mule connector part 10 and the female connector part 20 are formed as a substantially circular circumferential surface, when the outer peripheral surfaces 12*a* and 23*a* are viewed even in any direction, the shape in appearance is almost the same. This embodiment is particularly effective for connector configurations in which the front orientation cannot be recognized only from the appearance of the out r peripheral surfaces 12*a* and 23*a*; however, the present embodiment may be applied to a configuration in which the shapes of the outer peripheral surfaces 12*a* and 23*a* vary in accordance with the viewing direction as a matter of course.

Figure 5A:
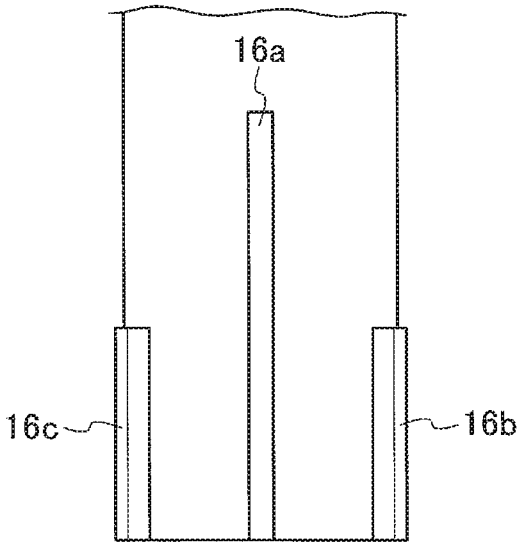
FIG. 5A is a view illustrating a front view of a male connector part according to a first variation.
Figure 5B:
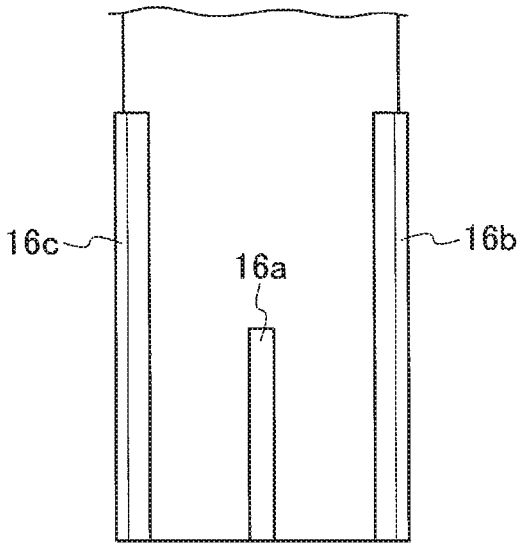
FIG. 5B is a view illustrating a front view of a male connector part according to a second variation.
Figure 5C:
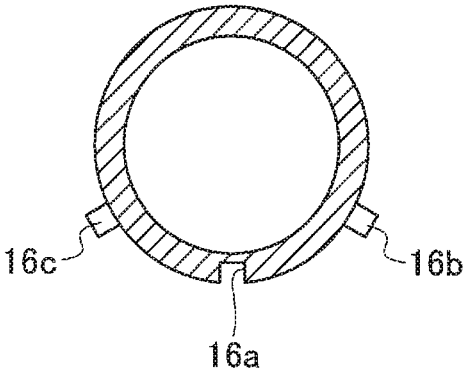
FIG. 5C is a view illustrating a cross-sectional view of a male connector part according to a third variation.
Figure 6:
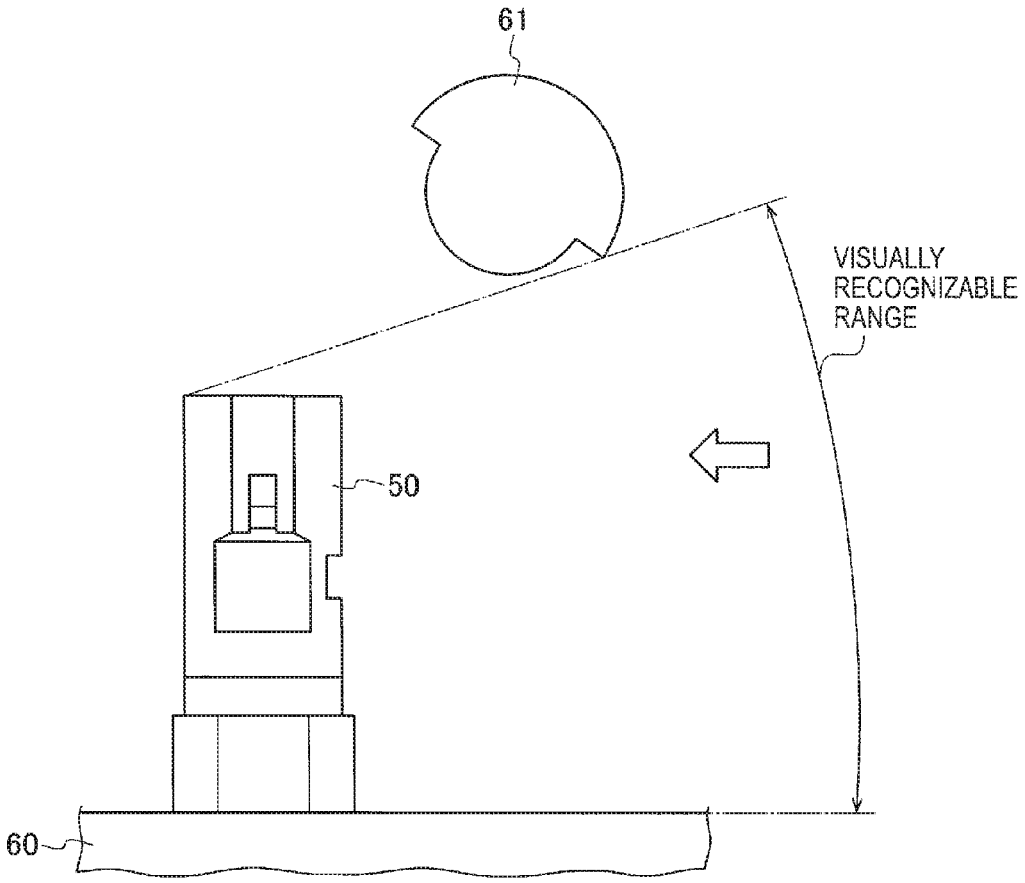
FIG. 6 PRIOR ART
FIG. 6 is a view illustrating an installation state of a first connector part according to a conventional example.

FIGS. 5A to 5C show modification examples of the front-alignment indicators. According to each of the modification examples, the male connector front-alignment indicators 16*b* and 16*c* on both sides are different from the male connector front-alignment indicator 16*a* at the center in the form. According to the first modification of FIG. 5A, the lengths of the front-alignment indicators 16*b* and 16*c* on both sides are formed to be shorter than the length of the front-alignment indicator 16*a* at the center in the front view. In the second modification of FIG. 5B, the length of the front-alignment indicator 16*a* at the center is formed to be shorter than the lengths of the front-alignment indicators 16*b* and 16*c* on both sides in the front view. In the third modification of FIG. 5C, the from-alignment indicators 16*b* and 16*c* on both sides are formed as protrusions, and the front-alignment indicator 16*a* at the center is formed as a groove in the front view. With this configuration, since recognition from the difference in the shapes is also added, the recognizability is further improved.

In the embodiment and modifications, the front-alignment indicators 16*a*, 16*b*, 16*c*, 26*a*, 26*b* and 26*c* are straight protrusions or grooves but may have shapes other than the straight shape, and also may have shapes other than protrusions and grooves. The front-alignment indicators 16*a*, 16*b*, 16*c*, 26*a*, 26*b* and 26*c* may have functions other than the recognition of the front orientation (e.g., guide ribs and the reinforcing ribs) in addition.

Although the embodiment of the present invention has been described heretofore, the embodiment is merely exemplified for facilitating the understanding of the present invention, and the present invention is not limited to the embodiment. The technical scope of the present invention may include not only the specific technical matters disclosed in the above-described embodiment but also various modifications, changes, and alternative techniques easily derived from the above-described specific technical matters.

What is claimed is:

1. A connector comprising:

a first connector part having a first terminal;

a second connector part being fitted to the first connector part in a prescribed fitting orientation and having a second terminal to be connected to the first terminal; and a plurality of front-alignment indicators provided on an outer peripheral surface of at least one of the first connector part and the second connector part such that at least one of the plurality of front-alignment indicators is visible even when the outer peripheral surface is viewed from any rotational angle direction and appearances of the plurality of front-alignment indicators change when a rotational angle direction from which the outer peripheral surface is viewed changes, wherein the plurality of front-alignment indicators are provided at three or more positions, and all of the front-alignment indicators are arranged in a region smaller than half the outer peripheral surface in a circumferential direction, and the front-alignment indicators located at both ends of the region in which the front-alignment indicators are arranged are protrusions.

2. The connector according to claim 1, wherein the plurality of front-alignment indicators are provided on both outer peripheral surfaces of the first connector part and the second connector part and the plurality of front-alignment indicators provided on both outer peripheral surfaces of the first connector part and the second connector part are provided at same rotational positions with respect to a front orientation.

3. The connector according to claim 1, wherein two front-alignment indicators located at both ends have protrusion heights such that both of the two front-alignment indicators are visible when viewed from a rotational angle direction opposite to a rotational angle direction from which all the front-alignment indicators can be seen to be located symmetrically.

* * * * *